United States Patent [19]

Spencer

[11] 4,432,941

[45] Feb. 21, 1984

[54] APPARATUS FOR THE DISTILLATION AND THERMAL CRACKING OF A CRUDE OIL FEEDSTOCK AND A REACTOR FOR USE THEREIN

[76] Inventor: Peter Spencer, 9 Links Close, Ashstead, Surrey, England

[21] Appl. No.: 311,018

[22] Filed: Oct. 13, 1981

[30] Foreign Application Priority Data

| | | | |
|---|---|---|---|
| Oct. 13, 1980 | [GB] | United Kingdom | 8033027 |
| Nov. 11, 1980 | [GB] | United Kingdom | 8036126 |
| Feb. 26, 1981 | [GB] | United Kingdom | 8106098 |

[51] Int. Cl.[3] ..... C10G 9/08

[52] U.S. Cl. ..... 422/140; 422/146; 422/203; 422/209; 422/235; 422/236

[58] Field of Search ..... 422/140, 139, 141, 236, 422/234, 235, 202, 203, 209, 230, 227, 231, 147, 146; 34/121, 58, 129, 59

[56] References Cited

U.S. PATENT DOCUMENTS

| | | | |
|---|---|---|---|
| 2,584,391 | 2/1952 | Leffer | 422/146 |
| 2,732,283 | 1/1956 | Clukey | 422/146 |
| 2,866,697 | 12/1958 | Elliott | 422/209 |
| 3,866,330 | 2/1975 | Hooper | 34/58 |
| 3,910,771 | 10/1975 | Chapman | 422/230 |
| 4,269,805 | 5/1981 | Schoengen et al. | 422/235 |
| 4,333,909 | 6/1982 | Stewart et al. | 422/141 |

*Primary Examiner*—Peter F. Kratz

*Attorney, Agent, or Firm*—Oblon, Fisher, Spivak, McClelland & Maier

[57] ABSTRACT

Disclosed is an apparatus for cracking heavy hydrocarbons—for example, petroleum oil or coal tar. The reactor comprises an outer spherical pressure vessel and an inner vessel within the outer vessel. The inner vessel has an open bottom end. The cracking reaction takes place in the inner vessel and the products leave through the open bottom end. The reaction is inhibited in the outer vessel since the contents are maintained at a temperature insufficient to sustain the cracking reaction. The product is withdrawn, either continuously or intermittently, via an outlet. The coke produced may be fluidized in the outer vessel or may be allowed to settle. The inner vessel may be rotated slowly about its vertical axis and high pressure fluid jets directed at its surface to dislodge coke deposited on the inside and outside wall.

The reactor may be used in a system for the simultaneous distillation and thermal cracking of crude oil. Feedstock is fed to a flash-settler having three sections. Liquid is withdrawn from the first section and fed to a reactor via a heater. The reaction products are quenched to inhibit cracking by means of a cooling stream prior to their introduction to the third section of the flash-settler. Coke is removed from the third section as a slurry. Gases flashed off from the feedstock and from the reaction products are fed to a distillation column where they are separated.

8 Claims, 4 Drawing Figures

APPARATUS FOR THE DISTILLATION AND THERMAL CRACKING OF A CRUDE OIL FEEDSTOCK AND A REACTOR FOR USE THEREIN

The present invention relates to a process and apparatus for the distillation and thermal cracking of a crude oil feedstock--for example, the simultaneous primary separation by means of distillation of crude oil into its main petroleum fractions and the thermal cracking of the heavier fractions, and to a suitable reactor.

In petroleum refining the initial stage of processing is generally to separate crude oil into its main petroleum fractions (namely, gas, naphtha, gas oils and reduced crude) by means of distillation. Sometimes, intermediate fractions are separated and these fractions are often further processed. The further processing is frequently the technique referred to as thermal cracking which may range from the relatively light process of visbreaking to the relatively severe process of coking. The feedstock for these processes may be reduced crude or in some cases vacuum residue. Vacuum residue is the term given to the bottom products from the processing of reduced crude in a distillation column under reduced pressure to separate petroleum fractions referred to as heavy gas oils from the vacuum residue.

In known applications, the distillation process and the thermal cracking processes are carried out separately.

In one known process of crude oil distillation, the crude oil is heat exchanged against previously separated petroleum fractions, passed through a fired heater and then passed to a distillation column. Sufficient heat is provided in the fired heater to effect the distillation. The distillation column normally operates at a pressure slightly above atmospheric pressure and the feed temperature to the column is normally restricted to about 345° C. to avoid thermal cracking. The quantity of reduced crude produced is usually about half the feedstock.

In a known process for the thermal cracking of reduced crude, the feedstock is passed directly into the bottom of a distillation column as is the outlet stream from a cracking reactor. The bottoms from the distillation column comprises the heavier fractions from the feedstock and the recycle. This is passed to a fired heater where it is heated to about 500° C. and then passed to a reactor, generally referred to as a coking drum. From the reactor the fluid product is returned to the distillation column where the lighter fractions flash off and are distilled into separate petroleum fractions.

These stages suffer from a number of disadvantages. There is usually excess heat in the distillation system and it is fairly common to recover this heat by means of steam generation in an inter-condenser. Clearly, this is wasteful in terms of energy. Furthermore, the process is regarded as dirty and there is a considerable deposition of solids in the form of coke, both in the heater and in other items of equipment, in addition to that formed in the coking drum, which also causes fouling.

It is an object of the present invention to simplify these processing steps and to reduce the combined thermal energy requirements.

It is a further object of the invention to increase the flexibility to accommodate a wide range of feedstocks and to enable a wide range of products to be obtained.

It is a further object of the invention to reduce the general fouling tendency due to deposition of coke outside the reactor, since this tends to impair process performance and tends to make process control more difficult.

It is a further object of the present invention to improve the product yield structure.

According to the invention there is provided a process for the distillation and thermal cracking of a crude oil feedstock comprising: introducing the feedstock to a separation vessel; withdrawing liquid, including heavier fractions, from the separation vessel; heating at least a portion of the liquid withdrawn from the separation vessel; reacting the heated liquid in a reactor where the heavier fractions are at least partially cracked; feeding an outlet stream, including cracked products, from the reactor to the separation vessel; withdrawing gas from the separation vessel and transferring the gas to a distillation column where the gas is separated into various fractions, and cooling the cracked products prior to their being fed to the separation vessel.

Preferably, the cracked products are cooled using liquids from the separation vessel, and such cooling may be effected within the reactor. Both liquid product and coke may be withdrawn from the separation vessel.

The process may include the further step of feeding liquid, including cracked products, to a reduced pressure column where the lighter fractions may be separated. The bottom product from the reduced pressure column may be recycled to the reactor and/or may be used to cool the cracked products. The top product from the reduced pressure column may be fed to the distillation column or may be removed as product.

Preferably, the separation vessel is a flash-settler which may be divided into three sections by means of two wiers. Liquid may overflow from the first to the second and to the third section over the first and second wiers respectively. Gases from the feedstock and from the reactor cracked products may be flashed off in the flash settler. The coke may be separated from the liquids by means of the first wier.

Preferably, the feedstock is heated prior to its introduction to the separation vessel by heat exchange with product streams from the distillation column and/or the reduced pressure column which may provide intercondensing and condensing heat exchange within the distillation systems.

It will be appreciated that the reactions which take place in thermal cracking are complex and are only partially understood. However, it is well known that some take longer than others. Ideally, when some light fractions have formed in the reactor they should be removed to minimise further cracking of these fractions into unwanted gaseous components. To remove selectively from the reactor those fractions which have cracked to the optimum degree is not practical, consequently, the residence time in the reactor represents a compromise between minimising the quantity of recycle without causing excessive cracking exposure. By providing the heat input required to effect both distillation of the feedstock and cracking at essentially one point, namely, a heater for the reactor feed, larger recycle quantities and shorter residence times can be catered for and thus a more desirable product yield may be obtained.

It is possible, therefore, that in the process according to the invention, the thermal energy consumed is less than the equivalent combined thermal energy consumed in crude distillation and thermal cracking when carried out separately. In a conventional thermal cracking process, the outlet temperature from the reactor is about 475° C. and normally contains thermal energy in excess of that required to distil the cracked liquid into the main petroleum fractions. Generally, in crude oil distillation, thermal energy is given to the distillation system. It will be appreciated that the process in accordance with the invention may exploit this imbalance so that the excess heat in the thermal cracking part of the process may be used in vaporising feedstock.

A further advantage of the process of the present invention is that the process may operate with only one atmospheric distillation column to separate the fresh crude feedstock and the cracked liquid into the lighter petroleum fractions. Furthermore, the heat exchanger requirements may be a good deal simpler.

A further advantage of the process in accordance with the present invention is that only streams in the vapour phase may enter the atmospheric distillation column, other than reflux, with the result that fouling in this major item of equipment may be minimised. Coke particles and other solids will tend to deposit in the flash-settler.

A still further advantage is that the process is particularly flexible and can accommodate fresh feedstock ranging from light crude to reduced crude and also be used to carry out processes ranging from mild cracking (visbreaking) to severe cracking (coking).

According to a second aspect of the present invention, there is provided apparatus for the distillation and thermal cracking of a crude oil feedstock comprising a separation vessel, a reactor and a distillation column; the separation vessel having a feedstock inlet, a gas outlet leading to the distillation column, a cracked products inlet leading from the reactor and a liquid outlet leading to the reactor, the apparatus further including means for heating liquid withdrawn from the separation vessel liquid outlet and means for cooling cracked products prior to their entry into the separation vessel.

The process taking place in the reactor is the cracking of heavy hydrocarbons, for example heavy petroleum oil or coal tar, and this thermal cracking may vary in severity from so-called visbreaking to a full coking reaction, though the preferred reactor of the invention is particularly applicable to the treatment of the heavy oils or bottom fraction obtained in petroleum distillation.

In petroleum distillation it is desirable to make full use of all the fractions produced. In the case of the heavier fractions, it is desirable to crack these into lighter products since these have more uses. This is generally carried out by heating the heavy oil in the absence of oxygen to such a temperature that the hydrocarbon molecules split to form lighter compounds. In a visbreaking process the cracking is not particularly severe with the result that comparatively little solid coke is formed. However, in a full coking reaction the heavy oil is cracked to such a degree that large quantities of coke are produced.

In one known process for cracking heavy oil, the feedstock is introduced to the base of a reactor column at a temperature of about 480° C. where cracking takes place. The lighter products, in the form of gases and liquids, are withdrawn from the top of the reactor and coke builds up within the reactor. In the case of visbreaking, this build-up is slow, taking perhaps up to a month or more, though in the case of coking, the build-up is rapid, taking perhaps only 24 hours.

This process suffers a number of disadvantages. The product recovered almost inevitably contains certain quantities of coke, which tend to block the apparatus downstream of the reactor. Also, cracking carries on in the product outlet, since the temperature is usually still sufficiently high, resulting in further coke production and deposition outside the reactor. Furthermore, the continual coke build-up results in a constantly changing reactor volume, with the result that the reaction parameters must be continuously adjusted in order to maintain a constant product composition. Finally, the coke builds up as a solid deposit which must be removed from the inside of the reactor by the use of high pressure water lances. This is costly, time-consuming and necessitates the reactor being taken out of commission at regular intervals to remove the coke deposits.

In a second known process the feedstock is introduced to a fluidised bed reactor in which the coke produced is fluidised. The product is removed from the top of the reactor. The coke is continuously withdrawn from the base of the reactor and transferred to the top of a second vessel to the base of which hot air and steam are introduced. This burns off part of the coke, and heats the rest of the coke which is continuously withdrawn from the vessel and fed back to the top of the reactor, thus providing heat for the endothermic cracking reaction.

This suffers from the disadvantages that the products withdrawn again tend to include some coke and again, further coke production can take place in the outlet. Also, this process is generally a low pressure process and can only effectively be carried out for a full coking reaction. Thus, the product range tends to include a greater proportion of lighter products which are less desirable, and the process is far less flexible.

It is an object of the present invention to provide a method and apparatus which does not suffer from the above disadvantages.

It is a further object to produce an apparatus which is capable of batch operation, semi-continuous operation and fully continuous operation.

According to another aspect of the present invention there is provided apparatus for the thermal cracking of heavy hydrocarbons comprising an outer vessel, an inner vessel located within the outer vessel, a feedstock inlet to the inner vessel, a gas outlet from the inner vessel, one or more product outlets from the outer vessel, a discharge port near the bottom of the outer vessel for the discharge of coke and means for cooling the contents of the outer vessel, there being an opening at the base of the inner vessel to allow cracked products, including coke, to leave the first vessel and to enter the second vessel.

Preferably, the outer vessel is spherical and may be a pressure vessel, while the inner vessel is preferably comparatively thin walled. There may be filtered outlets at the base of the outer vessel for draining the liquid product and fluid inlets at the base of the outer vessel to introduce fluid to the outer vessel thereby fluidising the coke. Preferably, the outer vessel is a good deal larger than the inner vessel to enable coke to settle and to accumulate if required.

According to a further aspect of the invention there is provided a method of thermally cracking heavy hydrocarbons which comprises passing a liquid feedstock of heavy hydrocarbons, at a temperature and pressure such as will allow cracking of the hydrocarbons to occur, into an inner vessel, the inner vessel being located within an outer vessel; allowing the cracked hydrocarbons, together with any coke produced, to pass out of the inner vessel into the outer vessel; maintaining the contents of the outer vessel at a temperature at which cracking of the hydrocarbons is inhibited (e.g. 325° C.); removing cracked product from the outer vessel, and removing coke from the bottom of the outer vessel.

Preferably, the contents of the outer vessel are cooled by withdrawing liquid from the outer vessel, cooling the withdrawn liquid and reintroducing it into the outer vessel, In one preferred method the coke is withdrawn continuously or intermittently while the cracking reaction is taking place whereby the process is in continuous operation In a second preferred method, the reaction is terminated, the liquid product is subsequently drained from the base of the outer vessel through one or more outlets having a filter, and the coke is then removed from the bottom of the outer vessel. In this case, the coke may be purged with steam prior to its removal but after the product has been drained.

In a third preferred method the fluid is withdrawn from the outer vessel and is reintroduced at the base of the outer vessel thereby fluidising the coke. The coke may be continuously or intermittently withdrawn as a slurry. Fluidisation may be effected by passing a portion of the cooling liquid through the fluid inlets at the base of the outer vessel. The outlets having filters may serve as the fluidisation fluid inlets. The cooling fluid need not necessarily be withdrawn from the outer vessel but may be any suitable fluid.

In a fourth preferred method the liquid cracked products, the coke and the cooling fluid may be withdrawn from the base of the outer vessel as a slurry continuously or semi-continuously to a settling tank. Vapourised cracked products may be withdrawn from the top of the outer vessel under pressure control.

Thus it may be seen that the invention may result in the minimal deposition of coke in the region of the reactor where cracking mainly occurs, and consequently where most coke is formed, namely in the inner vessel. Thus the volume of the reactor and space velocity of the reactants remain relatively constant over the operating cycle. Furthermore, since the inner vessel can be fabricated in sections, which can be assembled and disassembled into pieces that can be conveniently passed through a port in the outer vessel, the inner vessel can be readily removed and replaced by another vessel of different dimensions and therefore maintenance and modifications can be carried out fairly easily. This feature offers considerable flexibility to accommodate desired changes to the reactor performance including the possibility of using different feedstocks.

The retention time of the fluid passing through the inner vessel can be varied, the consequently the severity of cracking, by controlling the liquid level in the outer vessel, since the liquid level in the inner vessel is directly dependent on the liquid level in the outer vessel. It may also be seen that a large volume can be provided to accommodate coke accumulation within the main body of the reactor, namely in the outer vessel without subjecting the fluid to be cracked to excessive cracking exposure. Since the cracking is inhibited in the outer vessel, this will have the beneficial effect of discouraging coke particles formed in the inner vessel from coagulating into a mass in the outer vessel and forming constrictions in the outlet ports of the outer vessel also reducing the potential of coke to form in subsequent downstream items of equipment.

Although coke deposition may be minimised in such a reactor, certain amounts of coke do tend to deposit under certain circumstances, for example in full coking reactions involving heavy oils, when large amounts of coke are produced. The deposits may build up on the walls of the inner vessel, particularly on the inner wall.

Conventional methods of removing deposited coke from a coking drum include the use of a device which is lowered into the coking drum and which permits a high velocity water jet to be rotated and directed in such a way that it sweeps the inner surface of the coking drum and causes the coke deposits to be dislodged. This technique suffers the disadvantage that the coking drum must be at least partially cooled and purged and subsequently opened to provide access to the de-coking device. This is a slow and uneconomical operation.

It is an object of the present invention to enable a reactor, in particular the inner vessel of the preferred form of reactor described above, to be de-coked without the necessity to open, cool and purge the reactor.

According to a further aspect of the present invention apparatus for the thermal cracking of heavy hydrocarbons comprises an outer vessel and, within the outer vessel, an inner vessel having an opening at its base, the inner vessel being rotatable about a vertical axis, and nozzles located within the outer vessel and being directed at the surface of the inner vessel.

Preferably, the inner vessel is supported on structural members within the outer vessel by means of a ball race.

One of a number of methods may be employed to rotate the inner vessel, however it is preferable that the inner vessel should be caused to rotate slowly but positively against a varying resistant force. The inner vessel could be quite large, for example 5.0 meters diameter and 15 meters long. Together with the deposited coke its weight could be several tons.

One method may be to use a high velocity fluid jet to impinge tangentially to the axis of rotation of the inner vessel against a series of blades which are fixed to the inner vessel outside wall. By a combination of varying the number of jets and the pressure of fluid entering the nozzles the imparted force to cause the inner vessel to rotate can be conveniently varied and the speed of rotation controlled.

Another method to impart the necessary motive force to cause the vessel to rotate is to provide a fixed hydraulic motor which may interact with a circumferential attachment to the inner vessel causing it to rotate. Such a method may use established rack and gear arrangements.

To prevent the various nozzles from being occluded during the coking cycle, a small but constant fluid flow may be maintained through the nozzles.

This method of removing deposited coke may use as the fluid jets the hydrocarbon fluid normally used in the process of thermal cracking as feedstock or coolant recycle steam since the outer vessel need not be opened during the decoking operation, provided that the fluid jets do not contain solids that may cause occlusion in the nozzles and provided the fluid is at a lower temperature than that at which cracking occurs.

It will be appreciated that using the method of the present invention, the use of water jets may be avoided while the fluid jets used dislodge coke deposited on the walls of the inner vessel, by sweeping both the inside surface and those areas of the outside surface of the same vessel where coke may tend to deposit.

A further advantage which arises out of the employment of a reactor in accordance with the present invention is as follows. One of the problems encountered in some processes is metal poisoning of catalysts used in catalytic cracking reactions. It has been found that by using the reactor of the invention a portion of such poisoning metals can be removed from the fluid since some metals tend to deposit in the interstices of the coke, and this coke can be removed from the system prior to its reaching the catalyst. Thus metal poisoning of the catalyst can be minimised.

The invention may be carried into practice in various ways and two embodiments will now be described by way of example with reference to the accompanying drawings in which.

Figure 1:
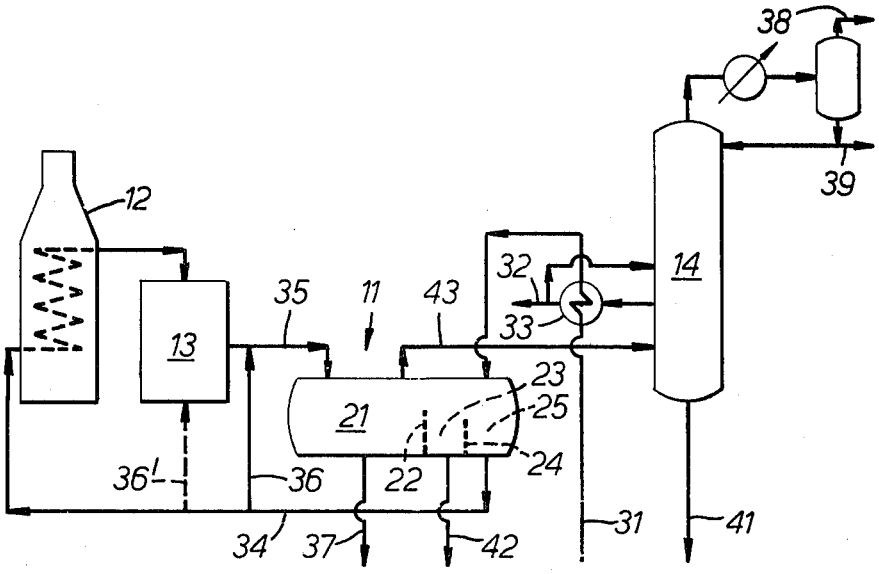
FIG. 1 is a schematic diagram of a first embodiment of a process in accordance with the invention.

Referring to FIG. 1, the apparatus comprises, essentially, a flash-settler 11, a cracker heater 12, a cracker reactor 13 and an atmospheric distillation column 14. The flash-settler 11 is typically 6 meters wide and is separated into three sections 21, 23 and 25 by means of two weirs 22 and 24 which are arranged so that liquid can overflow from section 21 into section 23 and then into section 25. The sections 21, 23 and 25 are typically 25 meters, 3 meters and 3 meters in length respectively.

The process operates as follows. The feedstock 31 is heat exchanged against a stream withdrawn from the distillation column 14 in a heat exchanger 33. Some of the stream is withdrawn as product in stream 32, while the remainder is returned to the column 14, providing cooling and/or inter-condensation at this section of the column 14. The heated feedstock is passed to section 25 of the flash-settler 11 where it is mixed with a recycle stream overflowing from section 23 of the flash-settler. The flash-settler typically operates at a pressure of 2 atm, and the temperature in section 25 is typically 200° C. A portion of this liquid from section 25 is fed to the reactor 13 via outlet stream 34 and heater 12.

In the reactor 13, the heavy fractions in the liquid are subjected to a temperature of about 500° C. and a pressure of about 7.0 atm and cracking takes place. The reactor outlet stream 35 is fed to section 21 of the flash-settler 11, and liquid from section 25 is used to quench the stream entering section 21. This may take place by means of a cooling stream 36 as the liquid leaves the reactor 13 or may take place within the reactor 13 by means of a cooling stream 36'. The liquid is quenched from about 475° C. to between 300° C. and 360° C. so that cracking of the streams entering the flash-settler 11 will have essentially stopped, but not over quenched so as to reduce vapour flashing off in section 21. Quench liquid may also be drawn from sections 21 and/or 23. The temperature in section 21 should be kept as close to 345° C. as is practically possible.

The quantity of quench liquid in stream 36 or 36' can be up to $2\frac{1}{2}$ times greater than the quantity fed to the heater 12, although this is dependent on the temperatures in section 25.

The reactor outlet 35 includes cracked fluid which may contain coke particles. As this enters section 21 of the flash-settler, coke particles can be allowed to accumulate and at the end of an operational run removed after the flash-settler 11 has been drained off and purged or alternatively coke particles can be removed from section 21 in slurry form via slurry outlet 37. The slurry may be led to a drain tank (not shown) and the separated liquid returned, or alternatively, the slurry may be returned to the reactor if the reactor is specifically designed to receive coke particles in slurry form. The temperatures in sections 25 and 23 are typically at about 275° C.

The size of section 21 and the form of a weir 22 ensures that the coke is trapped in section 21 and only liquid is allowed to overflow into section 23. If this liquid is not recycled it can be withdrawn as a liquid product 42.

A substantial proportion of the lighter fractions in the feedstock 31 will flash off in section 25 of the flash-settler. These will combine with vapour from the reactor outlet stream 35 which will flash off in section 21, and these are then passed to the distillation column 14 from gas outlet 43. Here they are separated into the main petroleum fractions, namely, gas 38, naphtha 39, light gas oils in product stream 32 and other gas oils 41. Intermediate products may be drawn off, if required.

Figure 2:
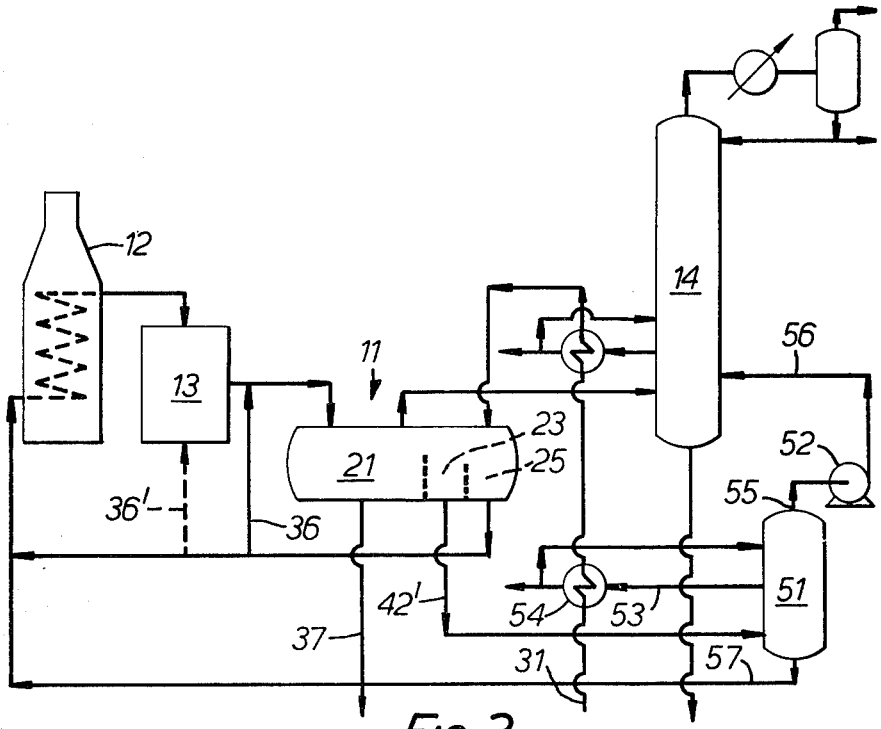
FIG. 2 is a schematic diagram similar to FIG. 1 showing a second embodiment.

FIG. 2 shows a second embodiment which may be used, for example, where a heavy gas oil fraction is required as a product. In this case, the system further includes a reduced pressure column 51. The system operates in substantially the same way as that described with reference to FIG. 1 except for the incorporation and interaction of the reduced pressure column 51.

Liquid from section 23 of the flash-settler 11 is fed to the reduced pressure column 51 via liquid product outlet 42'. A reduced pressure of about 0.2 atm is induced in the column 51 by means of a positive displacement compressor 52, though any suitable vacuum source may be used, for example a steam injection device. Heavy gas oil is flashed off and removed via gas oil product outlet 53. This stream is heat-exchanged against the feedstock stream 31 in a heat exchanger 54.

The overhead vapours 55 from the reduced pressure column 51 can be recovered as a product or alternatively are fed to the atmospheric distillation column 14 and introduced via a vapours inlet line 56 at a suitable point, typically a few trays up from the bottom of the distillation column 14.

The bottoms 57 from the reduced pressure column 51 can either be passed directly to the cracker heater 12, withdrawn as a product or returned to section 25 of the flash-settler 11. FIG. 2 illustrates the bottoms 57 being passed directly to the cracker heater 12.

In an alternative method of operation, some of the bottoms 57 from the reduced pressure column 51 are used as quench liquid, since the liquid will be at a temperature of about 225° C., instead of liquid in the cooling stream 36 or 36' from section 25 of the flash-settler 11. The liquid from section 25 would then all be passed to the cracker heater 12.

Figure 3:
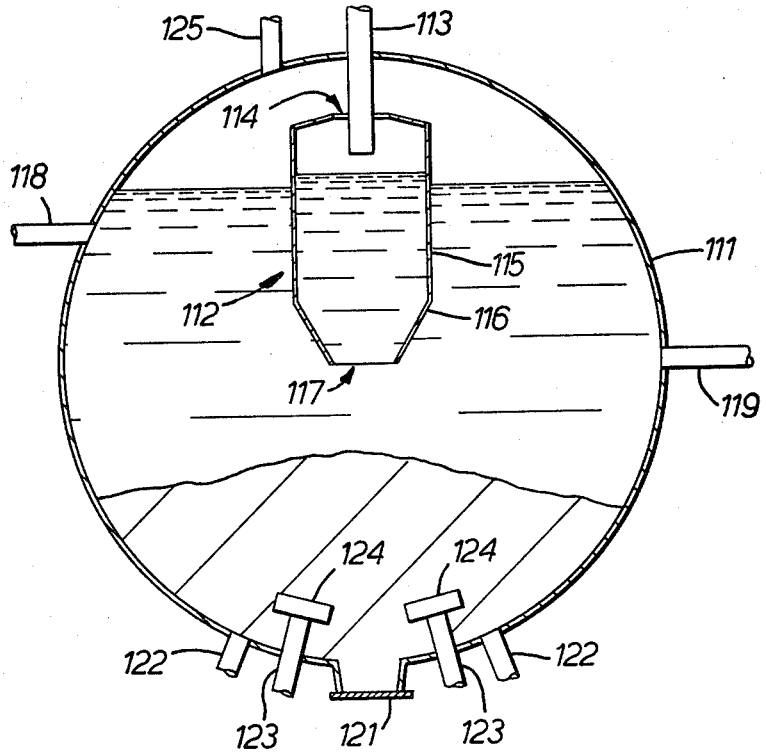
FIG. 3 is a schematic sectional view of a preferred reactor for use in the process of the invention.

The reactor 13 shown in FIG. 3 comprises a spherical outer vessel 111 capable of withstanding up to 140 atmospheres pressure and an inner vessel 112 having thin walls in comparison with the outer vessel 111. The inner vessel 112 is suspended within the upper part outer vessel 111 or attached to the upper part of the outer vessel 111 by any suitable means. The outer vessel 111 is 10.0 meters in diameter while the inner vessel 112 is approximately cylindrical, being 6.0 meters high and 3.5 meters in diameter.

A feedstock inlet 113 leads into the inner vessel 112 leaving a clearance 114 for the escape of gases. The inner vessel 112 has a generally cylindrical upper portion 115 and a generally frusto-conical lower portion 116 terminating in a wide-mouthed bottom opening 117, to minimise solids deposition in this region.

The outer vessel 111 has a liquid product outlet 118 in its upper region and a series of cooling fluid inlets 119 (only one being shown) arranged symmetrically about the outer vessel 111. The outer vessel 111 also has a bottom outlet 121, a series of fluidisation fluid inlets 122 (two being shown) at its base, and a series of fluid outlets 123 having filter elements 124 also at the base of the outer vessel 111. The inlets 122 may be used to withdraw the liquid cracked products, coke and cooling fluid as a slurry on a continuous or semicontinuous basis. Cracked vapour product may be withdrawn under pressure control from a gas outlet 125. All the inlets and outlets are provided with suitable valves (not shown) where necessary.

The reactor may be used in a number of ways to crack thermally, heavy hydrocarbons. In one such method, a feedstock of heavy hydrocarbons is introduced to the inner vessel 112 at a temperature of about 480° C. and at a pressure of about 40 atm. The liquid level in the outer vessel is adjusted so that the residence time is about 3 to 4 minutes. The feedstock is cracked lightly and the lighter products, together with the small amount of coke produced, leave the inner vessel 112 through the aperture 117 and enter the outer vessel 111.

The contents of the outer vessel 111 are maintained at a temperature of about 320° at which temperature, thermal cracking is inhibited, so that as soon as the cracked products enter the outer vessel 111, further cracking does not take place. The temperature in the outer vessel is maintained by withdrawing liquid product from the outlet 118, cooling a proportion of this liquid by any suitable means, and returning this to the outer vessel via the fluid inlets 119, which should preferably be directed towards the bottom opening of the inner vessel. The remainder of the liquid product withdrawn is removed as a product of the process. Since the liquid product outlet 118 is located near the top of the outer vessel 111, the amount of coke present in the liquid product stream may be minimised. Thus downstream contamination and blockages may also be minimised.

The coke produced settles to the bottom of the outer vessel 111 in the form of particles and is withdrawn intermittently through the bottom outlet 121. This can be carried out during the reaction process or during shutdown. In the latter case, the process is shut down and the outer vessel 111 is drained of liquid product through the filtered outlets 123. When this has been completed, the coke is purged with steam, cooled and withdrawn via the bottom outlet 121.

In another method, the feedstock is introduced in the same way as in the first method described above, however, the liquid level in the outer vessel 111 is adjusted so that the residence time is about 120 minutes, so that a full coking reaction takes place. In this case a large quantity of coke is produced.

Liquid product is withdrawn through the liquid product outlet 118 and as described above, some is removed as a product stream, while the remainder is cooled and reintroduced to the outer vessel 111. However, in this case, the recycled product is introduced through the fluidisation fluid inlets 122, thereby fluidising the coke particles. Thus, the liquid product will be in the form of a slurry of coke particles and so this is fed to a separation tank (not shown) where the liquid product is removed, partly for recycling to fluidise the coke in the outer vessel 111 and partly as a product stream. The coke is removed from the separation tank.

As an alternative, in this second method, the fluidisation may be arranged so that the liquid product withdrawn from the liquid product outlet 118 is substantially free from coke. In this case, the coke slurry is withdrawn from the base of the outer vessel 111 through one of the inlets 122 and transferred to a separation tank (not shown). Again, the separated liquid is reintroduced to fluidise the coke in the outer vessel, and the coke is removed after it has settled.

In these above described methods cracked vapour products may be withdrawn from the outer vessel 111 through the gas outlet 125 under pressure control and also cracked vapour products flashed-off in the separation tank removed through a vapour outlet (not shown).

Where the processes above are batch processes, two reactor systems may be used in sequence so that the process may be semi-continuous.

Figure 4:
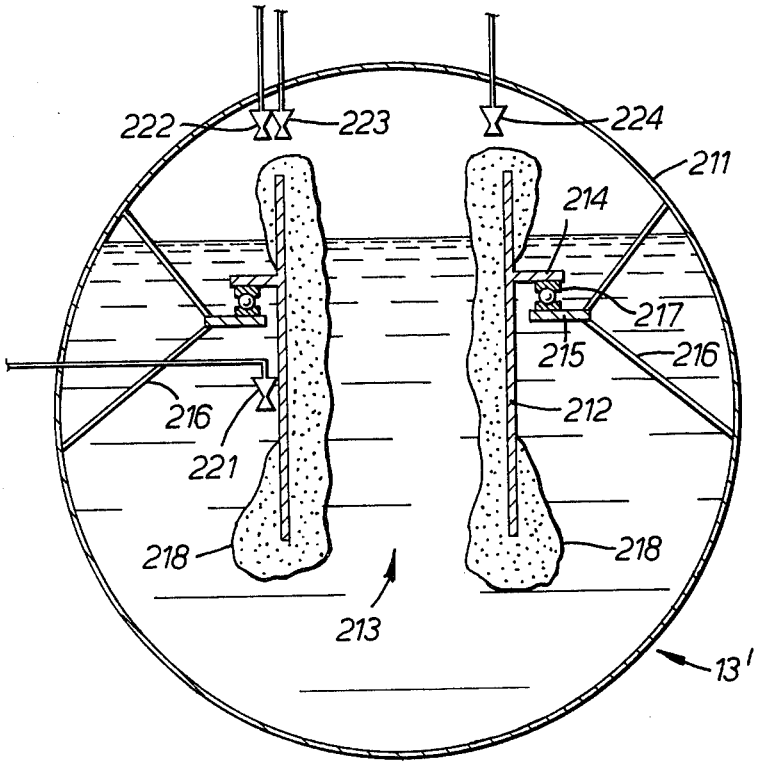
FIG. 4 is a view similar to FIG. 3 of a second preferred reactor.

The reactor 13' shown FIG. 4 comprises an outer vessel 211 and an inner vessel 212. The inner vessel 212 has an opening 213 at its base and a flange 214, about two-thirds of the way up from its base, attached to its outer surface. The outer vessel 211 has a support ring 215 located about two-thirds of the way up from its base by means of interior structural supports 216. The flange 214 is supported on the support ring 215 by means of a ball race indicated schematically by reference numeral 217.

A number of fixed nozzles 221,222,223,224 are located within the outer vessel and are arranged to direct fluid at the surfaces of the inner vessel 212. A hydraulic motor (not shown) is provided to rotate the inner vessel 212.

In use, as the cracking reaction continues within the inner vessel 212, coke may deposit on the surfaces of the inner vessel 212 as shown at 218. To remove this deposit, the liquid level in the outer vessel 211 is first lowered to approximately that of the base of the inner vessel 212. The inner vessel 212 is rotated slowly but positively about its vertical axis by means of the motor and fluid is discharged at a high velocity through the nozzles 221–224. The fluid impinges upon the inner vessel 212 and effectively sweeps its surfaces, thus removing the coke from both the inside and outside surfaces of the inner vessel 212. This operation may be carried out intermittently when required without cooling and purging the contents of the reactor vessel.

The fluid used may be the hydrocarbon feedstock or may be recycle coolant to the reactor. The reactor system is not opened during the coke dislodgement operation and the introduced fluid mixes readily with the reactor contents without undue adverse effects provided it does not contain solids which will cause occlusion in the nozzles or conduits leading to the nozzles.

By positioning the rotational support system and the motive force system which rotates the inner vessel about two thirds up from the bottom of the inner vessel, so that both these systems are normally below the liquid level during the cracking reaction, coke deposition on these driving systems will be substantially reduced because the temperature in this region will normally be about 345° C. Also, by maintaining a small but constant flow of fluid through the nozzles such that the temperature leaving the nozzles is less than about 345° C. (the temperature at which thermal cracking starts to occur), the nozzles will be kept free from occlusions.

In a modified form of reactor the inner vessel 212 is caused to rotate by means of blades attached to its surface. Nozzles are arranged to direct their fluid jets against these blades in a tangential direction with respect to the axis of the inner vessel 212.

What is claimed as new and desired to be secured by Letters Patent of the United States is:

1. Apparatus for the distillation and thermal cracking of a crude oil feedstock, said apparatus comprising:

(a) a distillation column;

(b) a reactor comprising:

(i) an outer vessel;

(ii) an inner vessel located within said outer vessel, said inner vessel having an opening at its base to allow cracked products, including coke, to leave said inner vessel and to enter said outer vessel;

(iii) a liquid feedstock inlet in said inner vessel;

(iv) a gas outlet from said inner vessel;

(v) one or more cracked products outlets leading from said outer vessel;

(vi) a discharge port near the bottom of said outer vessel for the discharge of coke; and (vii) means for cooling the contents of said outer vessel;

(c) a separation vessel comprising:

(i) a feedstock inlet;

(ii) a gas outlet leading to said distillation column;

(iii) a cracked products inlet leading from at least one of said one or more cracked products outlets leading from said outer vessel; and (iv) a liquid outlet leading to said liquid feedstock inlet in said inner vessel;

(d) means for heating liquid withdrawn from said separation vessel liquid outlet prior to entry into said inner vessel; and (e) means for cooling cracked products withdrawn from said one of said cracked products outlets in said outer vessel prior to entry into said separation vessel.

2. Apparatus as recited in claim 1 wherein said means for cooling the contents of said outer vessel comprise:

(a) a liquid outlet from said outer vessel and (b) a liquid inlet arranged to lead the cooled liquid back into said outer vessel.

3. Apparatus as recited in claim 1 and further comprising at least one fluid inlet port at the base of said outer vessel arranged to fluidize coke particles in said outer vessel.

4. Apparatus as recited in claim 1 and further comprising means for rotatably mounting said inner vessel about a vertical axis such that said inner vessel can be rotated about the vertical axis.

5. Apparatus as recited in claim 1 and further comprising:

(a) a reduced pressure column and (b) a liquid outlet from said separation vessel leading to said reduced pressure column.

6. Apparatus as recited in claim 5 and further comprising a heat exchanger arranged to permit heat transfer between the feedstock prior to its introduction into said separation vessel and a stream from said reduced pressure column.

7. Apparatus as recited in claim 1 and further comprising a heat exchanger arranged to permit heat transfer between the feedstock prior to its introduction into said separation vessel and a stream from said distillation column.

8. Apparatus as recited in claim 1 wherein said separation vessel is a flash-settler having one or more weirs dividing said flash-settler into sections, said weirs being arranged to separate solids from liquids and to allow liquids to flow from one section into another.

* * * * *